United States Patent [19]

Mureso

[11] 3,972,206

[45] Aug. 3, 1976

[54] PATTERN SELECTOR

[75] Inventor: Vladimir Mureso, Brno, Czechoslovakia

[73] Assignee: VVU Zavodu vseobecneho strojirenstvi, Brno, Czechoslovakia

[22] Filed: May 6, 1974

[21] Appl. No.: 467,120

Related U.S. Application Data

[63] Continuation-in-part of Ser. No. 309,948, Nov. 27, 1972, abandoned.

[30] Foreign Application Priority Data

June 25, 1970 Czechoslovakia ..... 4435

[52] U.S. Cl. ..... 66/50 R; 66/36

[51] Int. Cl.[2] ..... D04B 9/00

[58] Field of Search ..... 66/50 R, 50 B, 25, 75 A, 66/154 A, 36 A, 36 B

[56] References Cited

UNITED STATES PATENTS

| | | | |
|---|---|---|---|
| 1,697,488 | 1/1929 | Ames | 66/36 A |
| 2,080,525 | 5/1937 | Ames | 66/36 B |
| 2,913,887 | 11/1959 | Ducharme | 66/50 B |
| 3,240,032 | 3/1966 | Carrotte | 66/50 R X |
| 3,365,917 | 1/1968 | Schmidt et al. | 66/50 R |
| 3,512,377 | 5/1970 | Widdowson et al. | 66/50 R |
| 3,550,398 | 12/1970 | Widdowson | 66/50 R |
| 3,715,897 | 2/1973 | Hadam | 66/75 R |
| 3,742,732 | 7/1973 | Plath | 66/50 B X |
| 3,885,405 | 5/1975 | Bartels | 66/75 A |

FOREIGN PATENTS OR APPLICATIONS

| | | | |
|---|---|---|---|
| 1,500,569 | 9/1967 | France | 66/75 |

*Primary Examiner*—Louis K. Rimrodt
*Assistant Examiner*—Andrew M. Falik

[57] ABSTRACT

A knitting unit selection device for a knitting machine includes a plurality of pivotable knitting unit actuators which are aligned in one level of the machine and which cooperate with guiding cams to be brought into the influence of a single magnetic actuator at each of a pair of selection positions of the machine. The magnetic actuator includes a permanent magnet and a field-weakening electromagnet disposed at each of the selection locations of the machine. A pair of spaced cam-lifting arrangements are individually associated with the selection positions for moving certain of the needle units between a disengaged and a knit position and between a disengaged and a tuck position, respectively. Each of the cam lifters are so located relative to the successive needle units that the movement of the needle unit into engagement with the cam lifter when such unit is selected is identical for each of the cam lifters. Additional facilities are provided for maintaining the remainder of the needle units in the disengaged position.

4 Claims, 9 Drawing Figures

PATTERN SELECTOR

This application is a continuation-in-part of the application No. 309,948, filed Nov. 27, 1972, now abandoned.

BACKGROUND OF THE INVENTION

This invention relates to a knitting device with individual selection of working means, for instance of needle, slides, sinkers and similar means for creating pattern on a knitting machine, particularly on a large diameter circular knitting machine with rotating beds, stable needle cams, and with electronic programming of selection of working means in any working position, with two selection places, for each working system of the machine, whereby for selection an arrangement consisting of two individual selection magnets is applied, each of which comprising substantially two magnetic circuits, namely a magnetic circuit of permanent holding magnet with pole shoes of soft iron and a magnetic circuit of an electromagnet having a coil and a soft iron core with an air gap, representing a magnetic shunt for influencing the magnetic field of the permanent magnet.

Known arrangements of this kind which solve an individual selection of for instance needles on knitting machines for creating patterns, are always rather complicated, as for instance an arrangement with an electronic selection system located on the pattern wheel of a jacquard machine or a solution of a direct selection by a system of a number of electromagnets, which are demanding energetically and in their design, or an arrangement of a transfer mechanism or an auxiliarly device, enabling a contact of an operating extension of a working element (of a sinker, a needle, a slipper shoe) with a cam, or transmitting to the needle solely an initial operating stroke and enabling its whole operating stroke to be finished later, or an arrangement of a locking mechanism preventing the performance of an operating stroke of the needle, or finally a combination of magnetic switches and cam with electromagnets and similar means.

All these known arrangements require larger spaces, they solve the selection of needles usually in a single needle bed of the knitting machine only and enable a selection to two positions, a disengaged and a locking-in position or a disengaged and a rib position. The choice how the selected needles will operate (knit or tuck) must be taken in advance for instance by manual adjustment of certain switches or by the locking part of a cam system. Some arrangement require to make the whole selection within a time interval, corresponding to a track of the rotating machine part equal to one needle distance, what is rather demanding, particularly for machines having a fine needle distribution and higher rotating speeds. Similar arrangements require in such cases for instance a double selection system so that one system controls the even needles, the second system the odd needles, or some other device complicating the machine, for instance selectors and auxiliary sinkers with more butts in different planes so that the original advantages of the electronic selection with electromagnetical and mechanical elements, namely the simplicity, are lost. All these arrangements utilize for selection either high frequency electromagnets or permanent magnets with pole shoes of soft iron with coils, which are most suitable for the particular requirements of individual selection of needles for knitting machines in order to provide a reliable selection at any operating condition of the machine and to enable a better utilization of actual knitting machines particularly in their technological application together with a substantial simplification, particularly for machines having maximum possibilities of patterns and technology.

SUMMARY OF THE INVENTION

It is an object of this invention to eliminate the above mentioned drawbacks of existing knitting machines and to provide a knitting machine with individual selection where a selection of working means into any working position is enabled, where each needle or its slide is provided with a selection sinker pivotably suspended on a stable element, for instance on a bolt of a plate of the needle bed for compressing an elastic shank of the slide or the needle in the course of its guiding towards the selection magnet and in the course of its holding by the pole shoes of the selection magnet, whereby the respective needle remains disengaged from operation and provided furthermore with a lifter of these working means or of a system of working means, said lifter having two curved parts, a curved locking-in part and a curved rib part, mutually displaced, the whole arrangement being adapted to enable a shifting of the butt of an elastic shank of a slide or of an elastic shank of a needle always for the same distance and provided furthermore with a locking cam for retaining selection sinkers in a deviated and spring loaded position, which locking cam is provided with recesses situated exactly opposite both selection places adapted to enable the passage of released extremities of selection sinkers.

The knitting device according to this invention can be furthermore provided with a locking sinker in each needle slot for permanent locking of working means of the machine, that is of needles, slides or sinkers in a disengaged or in a working position, which locking sinkers are controlled by individual cam tracks of their working butts. The knitting device can for control of each selection sinker use the directing force of an elastic element, which can be for instance a needle with two butts and with an elastic shank, one of said butts being on the stiff part of the needle, the other on the elastic part of the needle.

According to another embodiment a special spring can be provided under a pivotally suspended needle, the directing force of which needle being utilized for selection of the selection sinker.

The arrangement according to this invention enables an individual selection of any needle for every working system of knitting machines both with needle dial and cylinder machines to any of three positions: disengaged, knit or tuck position and where a permanent distribution of needles would prove to be advantageous, their securing in disengaged or working position either without a time limit or up to the nex selection place, which possibilities can be utilized for knitting of patterns, where a group of working system knits with the same program of distribution of needles or other operating elements, resulting in a reduced stress of the knitting and selection mechanism and a reduction of power consumption. The possibility of selection on two beds of the machine and for all systems is particularly advantageous for semiregular, that is sweater-strip pattern machines and where the selection of pattern on both needle beds proves to be advantageous and has been up to now for mechanical knitting machines rather limited, requiring a manual operation (exchange and regrouping of needles, special machines with selection of sinkers and similar). The versability of the machine is thus incrased, including a possibility of knitting without electronics in case of a permanent arrangement of needles with large possibilities of application of this system of selection both for knitted work with a simple pattern program and with maximum possibilities of patterns of this machine. Considering the possibilities of electronics and particularly due to the complicated programming, it will be no doubt more advantageous not to use an electronic selection for some types of machines on a dial bed. The arrangement of the locking means of the lifter of the operation system with two mutually shifted curved elements caring for lifting the needle to a knit or tuck position is enabled by an always constant and at the same time small displacement of the actuating butt of the needle from the needle bed, reducing any bending or jamming of the needle in the slot and thus also reducing its resistance in the course of the working stroke, the stress, the wear and possible defects. The convenient solution of the knitting device and of the selection mechanism enables the use of the same kind of needles for both beds, a cam system, simple in design with a single track course and also a uniform selection system. Some arrangements according to this invention shorten the whole knitting system and reduce the height of the slotted or tricked bed part. After the performed selection, the needle works without any stress due to the selection mechanism. There is plenty of time for finishing the whole selection as a very small retraction of the selection sinker from the surface of the holding magnet is sufficient for a reliable selection in the course of the selection pulse so that it can no more pull it back after the electric pulse has finished, and the whole selection stroke is completed only thereafter within a time interval, which is more than sufficient. The approach of the selection sinkers towards the holding magnets can be accomplished any time prior the proper selection without need of any setting and adjusting of the exact position. The system enables furthermore knitting without electronics and with possibilities of a permanent distribution of needles, which is in that case made manually and in advance, the same as the respective adjustment of the guiding wedge of selection sinkers, enabling the lubricating and eliminating of needles which would otherwise knit, or their operation in the knit or tuck position. It is also possible to use for a permanent and quick distribution of needles in the course of one revolution of a certain machine type a portable electronic apparatus common to a number of knitting machines with a simple program and similar. The application of a joint supported selection sinker or the use of an otherwise stationary removable guiding wedge with a spring loaded end enables a soft and safe contact of the selection sinker on the surface of the holding magnet. All parts of the knitting and selection system can be replaced and are accessible easily and simply. The applied elements are of common design, as generally used on knitting machines.

DESCRIPTION OF DRAWINGS

The attached drawings show several examplary embodiments from the large number of possible applications of the object of this invention.

In the drawings.

DESCRIPTION OF PREFERRED EMBODIMENT

Figure 1:
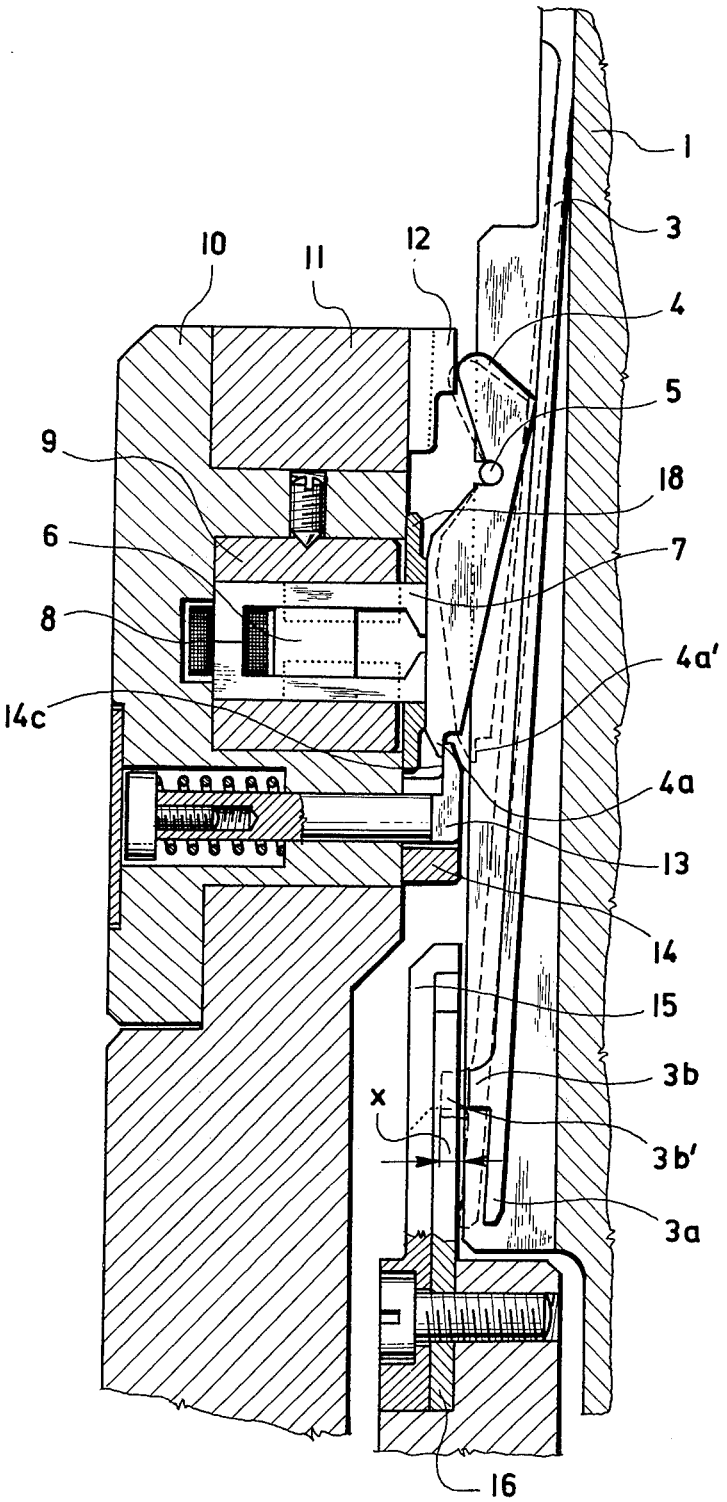
FIG. 1 is a side view of a first embodiment of knitting device with a selection arrangement for subsequent selection of round needles to three positions, using the directing force of a resilient shank of a slide, a stable cam for retaining not selected slides and a selection electromagnet.
Figure 2A:
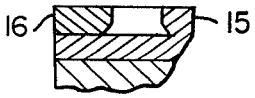
FIG. 2*a* is a fragmentary view in section, the section being taken along line A—A in FIG. 2.
Figure 2:
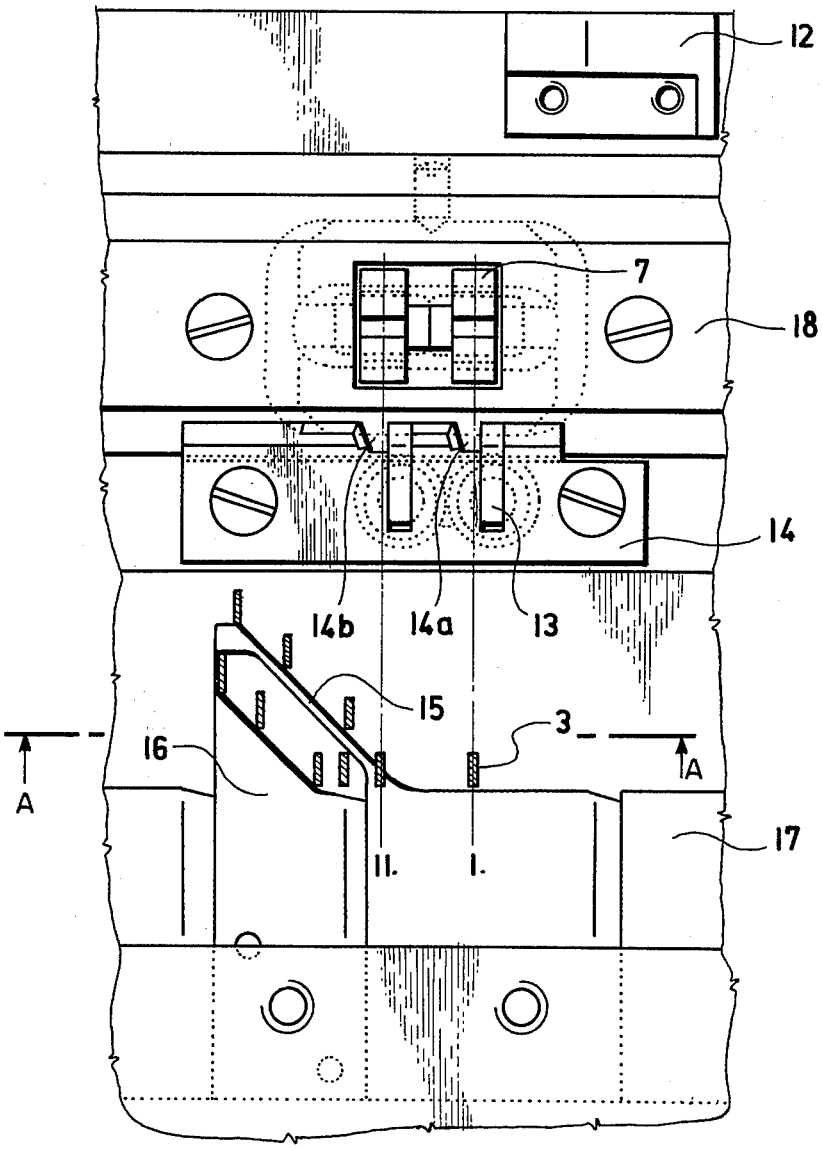
FIG. 2 is a view in elevation of the arrangement of FIG. 1.

In FIGS. 1 and 2 is a side view and an elevation of an arrangement for subsequent selection of round needles to three different positions. A needle unit including a not-shown needle is situated in a slot of a needle bed 1, said unit including a jack or slide 3 arranged under this needle, having a resilient shank 3*a* and a butt 3*b*, the direction force of which is utilized for the proper selection via a selection sinker 4. The selection sinker is positioned radially outwardly of slide 3, fulcruming around a stable element 5, for instance around a bolt.

A guiding wedge 12 and a spring loaded lug 13 located in a part of a mechanical locking needle cam 14 serve for drawing in the selection sinker 4 toward the selection electromagnet and resiliently holding it there. The electromagnet is composed of a core 6 with a permanent magnet, pole shoes 7, a coil 8 and a casing 9, with which it forms a unit located in a non magnetic insert 10 mounted in the support 11 of the magnet.

A subsequent selection at places 1 and 11 (see FIG. 2) which are for purposes of programming mutually spaced by a certain number of needle distances is accomplished by means of a cam (a lifter for raising the slides into the working position) comprising two curved parts, a clearing part 15 and a tuck part 16, the curved part 15 serving for raising the slide into a knit position, the curved part 16 for raising the slide into a tuck position. Both curved parts are situated between the guiding cam 17 for slide butts. The selection sinkers 4 move in the course of rotation of the cylindrical needle bed 1, in the plane of the pole shoes 7 of the selection electromagnet along a hard guiding sheet 18 of non magnetic material (for instance of nitrided stainless material) in order to prevent wear of the pole shoes of soft iron. When the butts of the guiding sinkers 4 come in contact with the guiding wedge 12, the selection sinkers 4 start to be deviated around the stable element 5, for instance around a bolt into the level of the front face of pole shoes 7 of the selection electromagnet, or the locking cam 14. They then come with their lug 4*a*′ to the position 4*a*, whereby the butt 3b for the slide changes from position 3*b*′ to position 3b, that is from a position out of contact with the cams 17 for guiding the slides and the curved cam parts 15 and 16 for the slides 3, that is into a disengaged position. Thus the selection sinkers 4 pass subsequently in a deviated position 4*a* to selection places 1 and 11, retained either by the pole shoes 7 of the electromagnet, or by the locking cam 14. At both selection places 1 and 11 an electromagnet is situated opposite the recesses 14*a* and 14*b* of the locking cam 14 which either retains the selection sinker 4 and enables its aligning behind the retaining edge 14*c* of the locking cam 14, or its release by an electric impulse, whereby the selection sinker 4 passes with its lug 4*a* through the recess 14*a* or 14*b* of the locking cam 14 due to the action of the direction force of the resilient shank 3*a* of the slide 3. Thus the butt 3*b* of the slide 3 comes again from position 3*b* to position 3*b*′ and consequently into engagement either (a) with the curved part 15 of the slide lifter, which lifts the slide 3 together with the needle into the knit position, if the release has been accomplished at selection place 1, or (b) with the curved part 16 of the slide lifter, which lifts the slide with the needle into the tuck position, if the release has been accomplished at selection place 11. In both cases the butt 3*b* of the slide traces the same path (position 3*b*, 3*b*′), which may be small, in order to have the projection of the butt 3*b* of the slide 3 for the distance *x* from the slot of the needle bed 1 as small as possible and thus reducing its stress to a minimum. The recesses 14 *a*, 14*b* of the locking cam 14 are only of such a width, to enable at the moment of release of the selection sinker 4 by the selection electromagnet the passage of a single selection sinker 4 only (of its lug 4*a*). The rest of the selection sinkers 4 which have approached and have been equally retained by the selection electromagnet, are also released, but since they are not aligned with the recesses 14*a* or 14*b*, they are restrained by the locking cam 14 and maintained in their deviated and spring loaded position (position 4*a* in FIG. 1). The release of the selection sinker from the pole shoes 7 of the selection electromagnet is accomplished by an electric impulse, whereby electric current passes into the coil of the electromagnet which excites a magnetic field coincident with the magnetic field of the permanent magnet 6, both these fields influence one another so that a reduction or complete compensation of the magnetic field of the permanent magnet 6 at its pole shoes 7 is the result, over which pole shoes 7 the magnetic field of this magnet is closed via the selection sinkers 4. The consequence thereof is the possibility of acting of the direction force of the resilient shank 3*a* of the slide 3 causing a withdrawal of the selection sinker 4 from the surface of the pole shoes 7 of the selection electromagnet and its passage through the recess 14*a* or 14*b* of the locking cam 14. A quite small withdrawal of the selection sinker 4 from the selection electromagnet is sufficient for this purpose as the retaining edge 14*c* (FIG. 1) of the locking cam 14 is situated close and with a minimum clearance near the lug 4*a* of the selection sinker 4 and is designed so as to prevent any contact of the lug 4*a* of the selection sinker 4 with this retaining edge 14*c*. The full stroke, that is the deviation of the selection sinker 4 from position 4*a* to position 4*a*′ and of the slide 3 from position 3*b* to position 3*b*′ into the operating position is accomplished in the course of a further angular displacement of the machine. It is therefore necessary to adjust the selection place 1 and 11 correctly with respect to the knit or tuck position in order that the butt 3*b* of the slide 3 is already safely beyond the slot of the needle bed 1 prior that it is started to be lifted by the curved parts 15 or 16, for which operation there is in the course of the working cycle plenty of time. The selection sinkers 4 which have not been selected at selection place 1 and the selection sinkers 4 situated behind the locking cam are guided by the spring loaded lug 13 and just prior to the selection place again brought towards the surface of the pole shoes 7 of the selection electromagnets by pull acting on the lug 4*a*.

If the knitting machine has a finer distribution of needles, a collision of the lug 4*a* of the selection sinkers 4 could occur with the edge 14*c* of the recess of the locking cam and it is in such cases advantageous to use instead of locking cams 14 permanent locking magnets, designed as a unit with the selection magnets. An exemplary embodiment of such a system of locking and selection electromagnets is indicated in FIG. 4 and 5.

Figure 3:
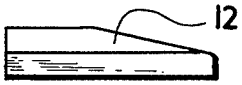
FIG. 3 is a top view of a guiding wedge in the device of FIG. 1 for guiding selection sinkers to the selection magnet and to the retaining cam provided with recesses enabling the selection.
Figure 4:
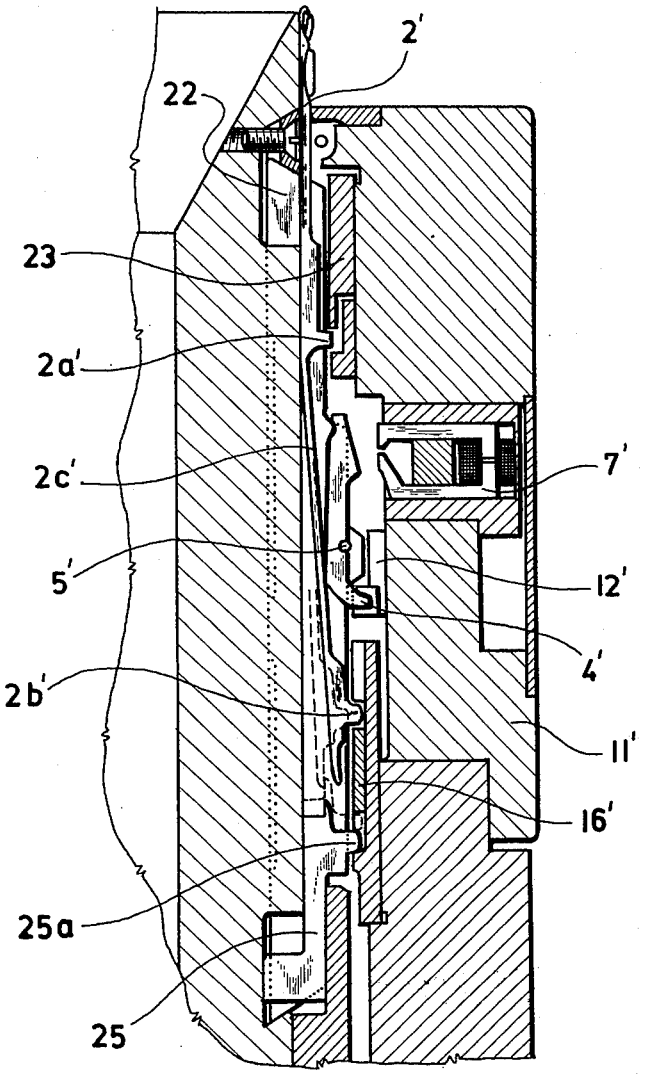
FIG. 4 is a side view of a second embodiment of the knitting device, such device having a selection device for subsequent selection of round needles to three positions, using the direction force of a resilient shank of the needle having two butts and furthermore holding the selection magnets with the possibility of a permanent distribution of needles to two positions by means of a locking sinker.
Figure 5:
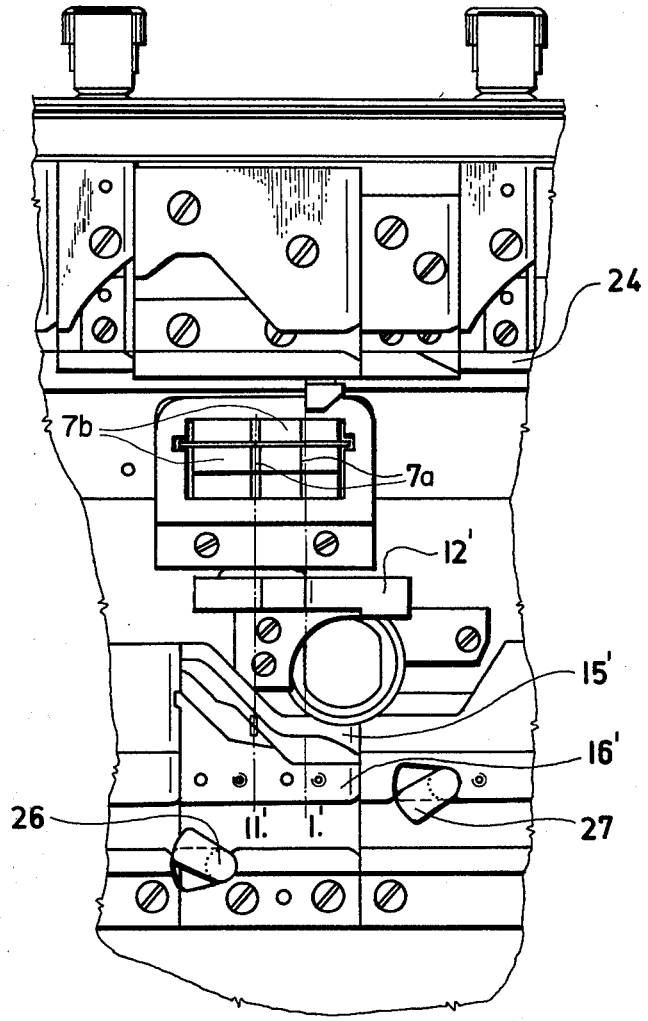
FIG. 5 is an elevation of the arrangement in FIG. 4.

The arrangement according to FIG. 4 and 5 has a similar selection system as above described. Parts in FIGS. 4 and 5 which are similar to those in FIGS. 1 – 3, inclusive, are designated by the same reference characters with an added prime.

In FIGS. 4–5, the function of the locking cam 14 of FIGS. 1 and 3 is taken up by a portion of the permanent magnet structure forming a part of the above-mentioned selection magnet assembly. Such permanent magnet structure is designated by element 7*b* of FIG. 5, while for convenience the associated electromagnet portions are designated 7*a*. The resilient shank 2*c*′ of the needle 2′ provides here the direction force for selection of the selection sinker 4′. The needle 2′ has two butts, an upper butt 2*a*′ for loops sinking by the wing cam 23 and guiding of the needle in the channel 24 in the course of selection and lower butt 2*b*′ for the proper selection and lifting of the needle into the knit or tuck position by curved 15′ and 16′. The arrangement comprises in addition a locking sinker 25; by the manual adjustment of its right pivotable extension 26 it is possible, to secure by means of selection sinkers 4′ the needles distributed by selection in their fundamental, that is the transit or working position after finished selection at places 1′ and 11′, but prior to their leaving the locking magnet. The release of this selection, for instance after a certain number of working system or selection places respectively or after one revolution of the machine, is again accomplished by prior manual adjustment of the left pivotable extension 27 situated so that the release of the permanent adjustment of needles is accomplished in front of the guiding wedge 12′ in front of the first selection place 1′.

The function of elements 25, 26 and 27 will be better understood from the following. The arrangement comprises in addition a locking sinker 25 which can, by manual adjustment of the right pivotable extension 26 of the corresponding needle selected according to the selection, be secured permanently by means of selection sinkers 4′ in the inoperative = missing position or in the knitting position, after finished selection at places I′ and II′, but prior to leaving the locking magnet. The release of this selection, for instance after a certain number of working systems or selection places respectively or after one revolution of the machine, is again accomplished by prior manual adjustment of the left pivotable extension 27 situated so that the release of the permanent adjustment of needles is accomplished in front of the guiding wedge 12' in front of the first selection place I.

In case of a permanent distribution of the needles, the guiding wedges 12' of the respective working systems have to be removed. By adjusting of the guiding wedge 12' we are able to decide whether the permanently distributed needles of the respective system will knit in the tuck or knit position or whether they will be inoperative by pressing their butts.

Figure 6:
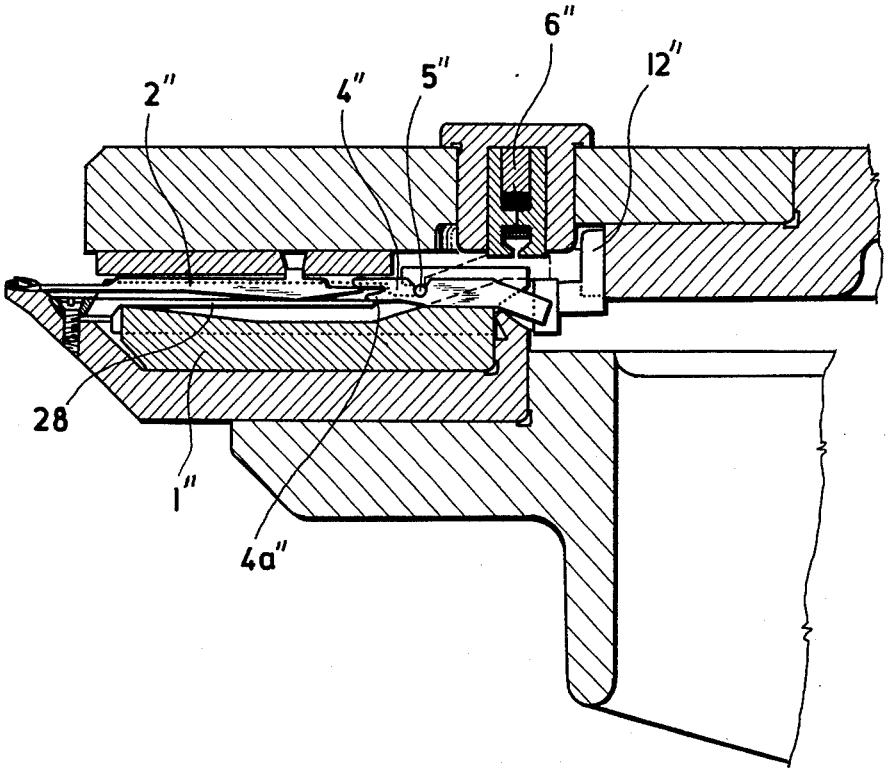
FIG. 6 shows a third embodiment of the device of the invention, such figure showing the arrangement of elements of the knitting and selection device for subsequent selection of dial needles to three positions using the direction force of an independent spring which is easily removable and situated below a pivotable needle with a system of holding and selecting magnets.

FIG. 6 shows a substantially similar solution as the previously described, but for selection of dial needles. Parts in FIG. 6 which are similar to those in FIGS. 1–3, inclusive, are designated by the same reference characters with an added double prime. A pivotable needle 2'' is applied here, with a flat spring 28 under the needle as source of the directing force required for selection. The selection sinker 4'' is brought towards a stationary element 5'' by means of the guiding wedge 12''. This arrangement is simple and is an example of a uniform arrangement of knitting and selection elements for selection of needles of both needle beds. The underlying flat spring 28, which can be easily removed from the needle bed by turning after removal of the selection sinker 4'', rests in its prestressed condition against the extension **4*a*'' of the selection sinker 4'' and presses the selection sinker 4'' against the bottom of the slot of the needle bed 1, so that the prestressing is compensated and is not transmitted to the needle 2'', which is thus not stressed by the selection mechanism in the course of the working stroke. As the needle 2''** has no guiding in the deviated condition, that is, when pressed into the slot, the selection channel of the needle butt is at the selection place somewhat widened and sloped in order to make the selection safe and the return movement of the needle without any difficulties.

The arrangement according to this invention, and in particular to FIGS. 1–3 thereof, operates as follows: Each slot of the needle bed 1 houses either a needle 2 with a resilient shank **2*c* or a pivotable needle 2 with an underlying spring 28 or a needle 2 and a resilient slide 3** as commonly used at mechanical Jacquard machines with a negative, that is compression selection method, or a needle and an auxiliary pivotable and spring loaded sinker or similar.

These resilient or spring loaded working means (in the following called only needles) of the machine have to be pressed down, that is deviated so, that their butts come beyond their guiding channel and the working system and thus into their inoperative position, in which position the needles remain up to the selection place 1 and 11 or also longer. The needles 2 are maintained in their inoperative position by the selection sinkers 4 suspended pivotable on a stable element 5, for instance on a bolt of the plate of the needle bed or similarly.

The selection sinkers 4 are in the same slots as the needles 2 and are situated outwardly of them. The selection sinkers are in fact two arm levers with their center at the fulcruming place, on one its arms (on the shorter one) the directing force of the compressed resilient or spring loaded needle is acting, what is accomplished subsequently in the course of turning the needle bed by the guiding wedge, whereby the second arm (the longer one) is approaching either towards the face of a stable holding magnet or behind a stable locking cam 14 and moves along its surface when the machine is turning. The lever transmission of the guiding sinkers 4 is utilized so that the holding power of the magnet is as small as possible. The selection sinker starts to deviate along its fulcruming point in the course of its contact with the guiding wedge 12 and approaches with its longer arm the holding magnet or the locking cam 14, whereby it simultaneously presses down the resilient or spring loaded needle 2, the directing force of which is later utilized for selection. A soft and safe approach of the selection sinker 4 towards the surface of the holding magnet or locking cam 14 considering manufacturing inaccuracies and elimination of backlash, may be achieved for instance by an adjustable auxiliary guiding wedge (not shown), which cooperates closely with the stable guiding wedge 12 arranged so to influence a single sinker 4 only just prior to its approach to the holding magnet or to the locking cam 14.

The working extremity of the selection sinker can be also for the same reason arranged independently and joint connected with the selection sinker (not shown on the drawing). The selection sinkers held by a permanent magnet or by a locking cam and the needles thus secured in an inoperative or spring loaded position are subsequently brought in the course of turning of the needle bed to the selection place. There are two selection places 1 and 11 for each working system, distant one from the other for a small predetermined exact number of needle distances. At both selection places 1, 11 selection magnets of the selection device are provided, which magnets act at the given moment either as holding magnets or as locking cams, or they accomplish a selection. They are controlled by electric impulses according to the program of an electronic pattern device conforming to the required pattern so that the selection sinkers are by these electric impulses released from the magnets. In case no selection is accomplished, the selection sinkers are attracted by the magnets and brought to a subsequent magnet or locking cam and to the second selection place, where the described operation is repeated. The subsequent selection at two places and the construction of the locking part of the lifter with two curved parts 15, 16 enable either the release of the respective needle at the first selection place 1 so that it can reach with its butt **3*b* the first, the so called knit part 15 of the divided locking-part the lifter — and operate in the locking-in position, or to retain and release it at the second selection place 11 in order to be able to contact with its butt 3*b* the second, so called tuck part 16 of the lifter and operate in the tuck position, or finally by prolonged retaining of the needle by the holding magnet or by the locking cam and control of the selection achieve that the butt of the needle passes through the locking cam in a disengaged position either to a further selection place, to be secured in this disengaged position, or to pass into the throughgoing guiding channel after leaving the locking cam or magnet. The permanent securing of the needle in the disengaged position is accomplished by a locking sinker 25 and by a manually controlled switch, which guides the locking sinker 25 into the locking position. Both selection places 1 and 11 are situated to enable, considering the design of the locking part the lifter with both curved parts that the needle, released at selection place 1, which place is sufficiently in advance of the first curved part of the lifter, can only by its springing force or by the force of a flat spring 28 situated below the needle or by a similar device be introduced by its butt into the guiding channel of the needle butts and subsequently into engagement with the first curve of the lifter, which lifts it into the knit position. Needles released only at the second selection place 11 situated behind the curved part 15 for the knit position, rest at the first moment of release caused by selection due to action of the direction force with the face of the needle butt against the rear side of the first curved part 15 of the lifter, as they are retained thereby and are subsequently passing by their butts through the cavity of the locking cam between the first and second curved part of the lifter and finally to the second curved part 16,** which causes the needles to be lifted into the tuck position. The construction of the lifter with the two curved parts enables a shifting of the needle butt from the slot of the needle bed always for an equal small distance, the needle is less stressed, there are smaller resistances in the course of the movement of the needle into its working position and thus also a smaller wear and a reduced possibility of deformations or defects of the needle. The proper selection device is of course adjusted to this subsequent selection.

The selection device can be for instance a known electromagnetic selection system comprising permanent holding magnets and selection magnets (permanent and electomagnets) accommodated to the subsequent selection of the needle to three positions, or some known combinations of magnets.

It consists for instance of a group of a stationary locking cam 14 with recesses 14*a*, 14*b* situated exactly opposite the selection places 1 and 11, having a width of approximately one distance of two needles of the finest considered needle distribution and arranged so as to enable a release of the selection sinker and its passage through the recess of the locking cam and with selection magnets, the pole shoes of which are situated opposite to the recesses in the locking cam and which cover these recesses, which magnets may be permanent or electromagnets. Permanent magnets are more suitable in order to prevent faults when cutting out the electronic circuits when stopping the machine and in similar cases, while with electromagnets, the selection sinkers which are just at selection places, would be spontaneously withdrawn and would cause unwelcomed faults of the knitted material.

In the arrangement according to this invention, the deviated spring loaded selection sinker is maintained in the selection by the locking cam with recesses or at the selection places opposite to these recesses by individual selection magnets. At the amount of selection the selection sinker opposite to the recess of the locking cam is released, the selection sinker passes through the recess of this cam and enables a resilient or spring loaded needle to enter with its butt into the guiding channel or in engagement with the lifter. The selection sinker and thus also the needle thereby do not perform a full working stroke within the short time of the track of the needle bed for one needle distance, but the selection sinker need only to come with the edge of its lug 4*a* behind the retaining edge 14*c* of the recess 14*a* or 14*b* of the locking cam 14, which retaining edge enables to finish the slower deviation of the selection sinker. The distance required for this purpose can be very small, some tenths of a millimeter are sufficient for a reliable selection. Only after that the whole working stroke of both the selection sinker and of the needle is finished.

The selection magnet consists for instance of a core of a permanent magnet, pole shoes of soft iron, which form the contact surface for the selection sinker and of an electromagnet with a divided core of soft iron with an air gap which, if an electric impulse reaches its coil, forms a magnetic shunt with a magnetic field coincident with the magnetic field of the permanent magnet and thus weakens or compensates the magnetic fields of the pole shoes of the selection magnet.

Another selection device uses instead of locking cams permanent holding magnets with pole shoes of soft iron covering the whole width of the selection sector so that they form a continuous surface, interrupted by narrow recesses so that at selection places narrow surfaces of the selection part of this permanent magnet are created, which are at the moment of selection influenced in the above described manner by an electromagnet with a core having an air gap.

Figure 7:
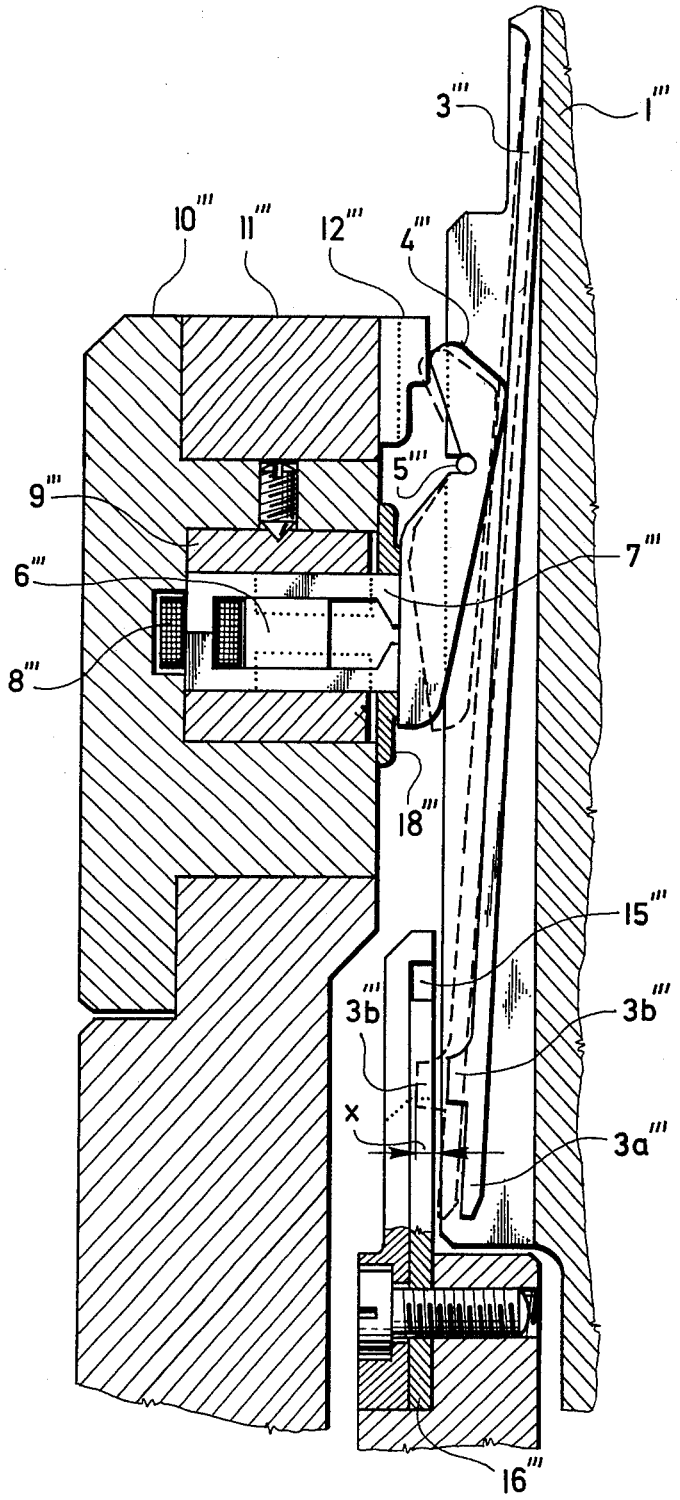
FIG. 7 is a view in side elevation of a fourth embodiment of the knitting device of the invention; and, FIG. 8 is a view in elevation of the device of FIG. 7.
Figure 8:
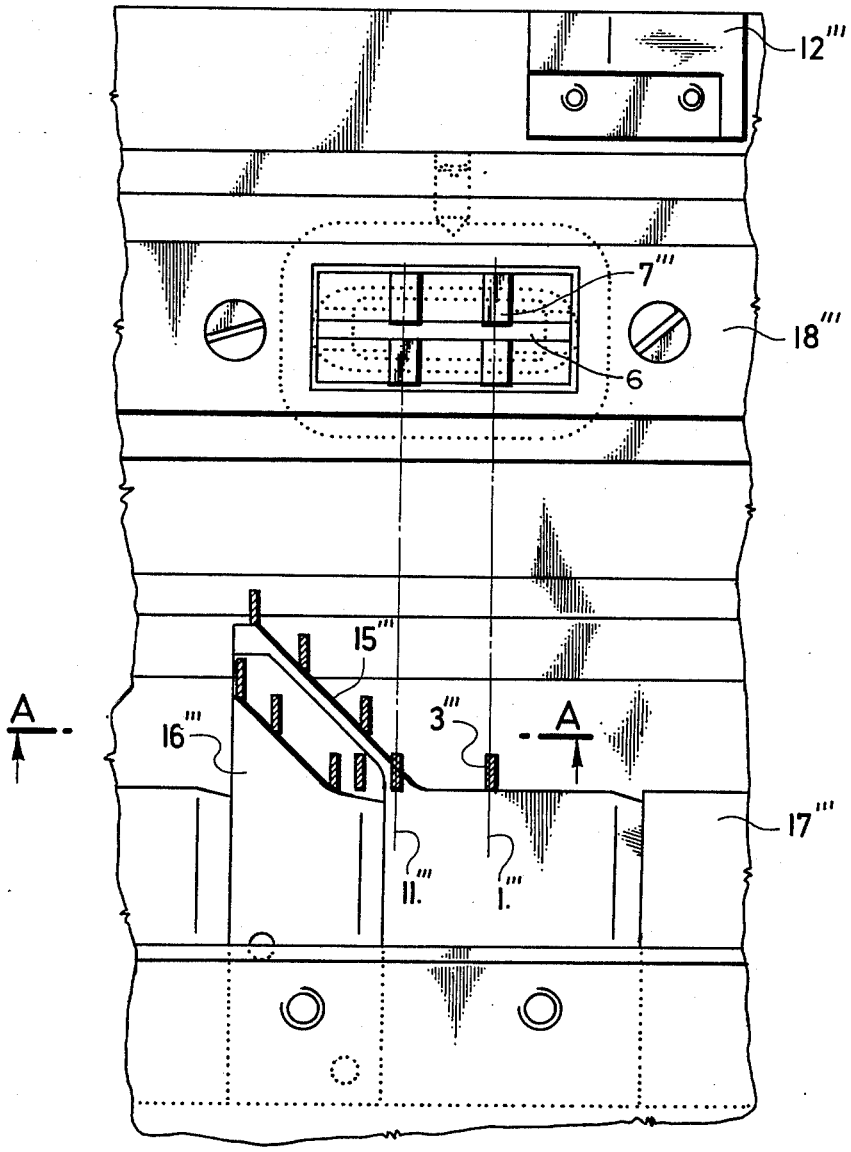

The fourth illustrative device in accordance with the invention is shown in FIGS. 7 and 8. In such figures parts which are similar to those in FIGS. 1–3 are designated by the same reference characters with three added primes.

A selector sinker 4''' which is pivotably suspended on a pin 5''', in a needle bed 1''', is so swung out by a cam edge 12''', in case the needle cylinder is under rotation, that it may engage the surface of a de-energized selection magnet 7''' having a permanent magnet core which then holds it in such position. The selector sinker 4'''being swung out presses simultaneously on the resilient shank of a slider 3'''. which causes its butt to move from the position 3''' *b* into the another one 3*b* '''.

When the needle cylinder 1''', with needle beds 1''', is under rotation, the selection means gradually get to the points of selection I''' and II''', where the coils of selection magnets 7''' can be energized thereby producing a field counter to and stronger than that of the core of the permanent magnet 6. This leads to release of the selector sinkers 4''' from the surface of the permanent magnet cores, and the butts of the resilient shanks of the sliders 3''' are thus allowed to spring back from the position 3'''*b* into the position 3*b* ''' and to get in each of a raising cam 15''' or 16'''. This the selection and working means take up the clearing or tuck position.

In case the selection magnets 7''' are not energized, at the points I''' and II''', the selector sinkers 4''' continue to be held on by a contact surface of the permanent magnet core of the selection magnet, the butts of corresponding selection means can be touched by none of the raising cams 15''' and 16''' and selection and working means pass on into a no-knitting position.

The advantages of this arrangement consists in the fact that the guard cams could be left out and their function has been taken over by the very contact surfaces of the cores of the selection magnets 7'''.

The described knitting device with a selection according to this invention can be used with different adjustments and similar solutions or with their combinations also for small diameter machines, for flat, single or two bed machines for selection of sinkers and needles on special knitting machines manufacturing backed cloth and plush, for machines with pattern forming by repositioning and for machines with circulating cams and similar machines.

Although the invention is illustrated and described with reference to a plurality of preferred embodiments thereof, it is to be expressly understood that it is in no way limited to the disclosure of such a plurality of embodiments but is capable of numerous modifications within the scope of the appended claims.

What is claimed is:

1. Knitting device with individual selection of needle units for pattern producing on a knitting machine, comprising at least one needle bed with a number of slots for the needle units, each needle unit having at least one part spring-loaded, forcing said part out of said slot, said needle units individually provided with selection sinkers, said selection sinkers being disposed at one level of the machine, each said selection sinker suspended pivotably on a part mounted on the needle bed and stationary relative thereto, said selection sinker being adapted for compressing the spring-loaded part of the needle unit into its slot in the needle bed, each needle unit adapted for selection at two selection places spaced apart a predetermined number of needle distances and adapted for relative movement with respect to the needle bed, a single selection magnet having a permanent magnet and pole shoes disposed at each selection place, each selection magnet provided with means for temporary substantial reduction of the power of its magnetic field by electric signals, means for causing the selection sinker prior to selection to be brought within the influence of the magnetic field of the selection magnet causing a simultaneous compression of the needle unit into the respective needle slot, the permanent magnet of each selection magnet retaining selected sinkers, the temporary reduction means being actuated by electric signals for overcoming the attraction between selected sinkers and the permanent magnets whereby to release only said selected sinkers, lifter means comprising one curved knit part and one curved tuck part, each of said curved parts corresponding to a respective one of said selection places, the respective curved pasts being individually adapted to engage the butt of the needle unit when the latter extends beyond its slot in the needle bed to lift it from a normal disengaged position to knit and tuck positions, respectively, said curved parts being located the same distance from the needle bed so that the extension of the butt of a selected needle unit from the needle slot into engagement with either of said curved parts is identical.

2. Knitting device as in claim 1, further comprising a locking sinker in each needle slot for permanent locking of the needle unit in a selected one of the disengaged, knit and tuck positions, said locking sinkers provided with butts, and individual cam tracks for said butts controlling the position of said locking sinkers.

3. Knitting device as in claim 1, each needle unit composed of a stiff part and of a resilient shank, a butt on the stiff part and a butt on the resilient shank for respectively effecting movement to the disengaged and to a selected one of the knit and tuck positions, the directing force of said elastic shank controlled by said selection sinkers.

4. Knitting device with individual selection of needle units for pattern producing on a knitting machine, comprising at least one needle bed with a number of slots for the needle units, each needle unit including a slide having an elastic shank normally urged out of the slot and a butt extending outwardly from the slide, said slides individually provided with selection sinkers, said selection sinkers being disposed at one level of the machine, each said selection sinker suspended pivotably on a part mounted on the needle bed and stationary relative thereto, said selection sinker being adapted for compressing the shank of the slide into its slot in the needle bed, each slide adapted for selection at two selection places spaced apart a predetermined number of needle distances and adapted for relative movement with respect to the needle bed, a single selection magnet having a permanent magnet and pole shoes disposed at each selection place, each selection magnet provided with means for temporary substantial reduction of the power of its magnetic field by electric signals, means for causing the selection sinker prior to selection to be brought within the influence of the magnetic field of the selection magnet causing a simultaneous compression of the shank into the respective needle slot, the permanent magnet of each selection magnet retaining selected sinkers, the temporary reduction means being actuated by electric signals for overcoming the attraction between selected sinkers and the permanent magnets whereby to release only said selected sinkers, lifter means comprising one curved knit part and one curved tuck part, one of said curved parts corresponding to a respective one of said selection places, the respective curved parts being individually adapted to engage the butt of the shank when the latter extends beyond its slot in the needle bed to lift it from a normal disengaged position to knit and tuck positions, respectively, said curved parts being located the same distance from the needle bed so that the extension of the butt of a selected shank from the needle slot into engagement with either of said curved parts is identical.

* * * * *